US005711565A

United States Patent [19]

Smith et al.

[11] Patent Number: 5,711,565

[45] Date of Patent: Jan. 27, 1998

[54] UNIVERSAL ENGAGING MECHANISM FOR COLLECTION CONTAINERS

[75] Inventors: Fred T. Smith; Fred P. Smith, both of Alpine; Kevin McAllister, Orem, all of Utah

[73] Assignee: Galion Solid Waste Equipment, Inc., Galion, Ohio

[21] Appl. No.: 568,599

[22] Filed: Dec. 5, 1995

[51] Int. Cl.[6] ..... B65F 3/04; B66C 1/44

[52] U.S. Cl. ..... 294/88; 294/106; 294/902; 414/408

[58] Field of Search ..... 294/86.4, 88, 106, 294/902; 414/406–408, 555, 620, 621

[56] References Cited

U.S. PATENT DOCUMENTS

| | | | |
|---|---|---|---|
| 2,821,317 | 1/1958 | Locke | 414/621 |
| 4,227,849 | 10/1980 | Worthington | 414/555 |
| 4,427,231 | 1/1984 | Smith . | |
| 4,461,607 | 7/1984 | Smith . | |
| 4,669,940 | 6/1987 | Englehardt | 294/106 |
| 4,708,570 | 11/1987 | Smith et al. . | |
| 5,020,844 | 6/1991 | Pickrell . | |
| 5,092,731 | 3/1992 | Jones et al. . | |
| 5,209,537 | 5/1993 | Smith et al. . | |
| 5,222,853 | 6/1993 | Carson | 414/408 |
| 5,398,983 | 3/1995 | Ahrens | 414/406 |
| 5,562,386 | 10/1996 | Browning | 414/406 |

FOREIGN PATENT DOCUMENTS

| | | | |
|---|---|---|---|
| 3614-328 | 10/1987 | Germany | 414/406 |
| 592-738 | 2/1978 | U.S.S.R. | 294/902 |
| 94/18098 | 8/1994 | WIPO | 414/408 |

OTHER PUBLICATIONS

*Rapid Rail Systems*, "High Speed Collection Services Up To 1,000 Homes Or More Per Day," 2-page article, no date.

Rand Automated Compaction Systems, Inc., "Rand Challenger II," 8-page glossy brochure.

Schematic AA-24085-00, dated Jan. 12, 1993, entitled "Gripper Assy, 90 & 300 Gallon," and Schematic AA-24200-00, dated Apr. 10, 1994, entitled Tip Roller Set, Wayne Engineering Corp., Cedar Falls, Iowa.

Photograph of prototype of the invention disclosed in U.S. Patent No. 5,209,537.

*Primary Examiner*—Dean Kramer

*Attorney, Agent, or Firm*—Niro, Scavone, Haller & Niro

[57] ABSTRACT

A universal engaging mechanism for handling collection containers of a variety of sizes and shapes. The mechanism includes two arms rotatably mounted to a base and movable between open and closed positions, and a retainer located adjacent the base and between the arms. As the arms close about the container, the arms urge the container in a transverse direction toward the base, until the container abuts the retainer. The arms and the retainer also cooperate to inhibit longitudinal movement of the container and container sway during handling. A method for using the universal engaging mechanism of the present invention to handle containers of a variety of sizes and shapes using the universal engaging mechanism is also described.

15 Claims, 14 Drawing Sheets

UNIVERSAL ENGAGING MECHANISM FOR COLLECTION CONTAINERS

BACKGROUND OF THE INVENTION

The present invention relates to a mechanism for engaging and handling collection containers of a variety of shapes and sizes.

While the invention will be described with particular reference to the collection of refuse, it will be understood that the present invention has a wide variety of applications and uses for engaging various types of collection containers. The collection of commercial and domestic waste and trash has increasingly become mechanized and automated. Refuse is typically deposited and temporarily stored in conveniently located containers. These containers substantially vary in size and shape. The contents of the containers are received by a refuse collection vehicle for ultimate transfer to a disposal site. The refuse collection vehicle often utilizes an automated arm that can engage, lift, tilt and dump the container functions (generically referred to here as "handling"), and then replace the container in a resting, typically curbside, location.

Refuse containers are readily commercially available in an array of types, sizes, and configurations. Round, square and rectangular containers, as well as containers of other shapes, are all available. The containers may be stationary or portable, large or small, have tapering or straight sides, may have lids or no lids, and can be constructed of various materials, including metal, fiberglass, wood or plastic. As used here, the term "container" is intended to include any enclosed structure capable of holding material, including refuse or other materials.

For exemplary purposes only, some conventional refuse containers will now be described. Large round containers having capacities ranging up to 400 gallons and diameters as large as 48 inches are available, as are smaller containers having capacities as small as 30 gallons and diameters of 15 inches. Often, refuse containers include a continuous, upright side wall having an outwardly sloping taper in the general range of 4° to 7° which facilitates mold release and stacking. Refuse containers are often fabricated of a flexible plastic or rubber, such as polyethylene, using various conventional molding processes, and have a relatively flexible side wall with a substantially smooth exterior surface.

A conventional refuse collection vehicle includes a cab, a body for storing refuse positioned at the rear of the cab, and a container-handling mechanism (e.g., a lift arm or boom connected to a container gripper) carried on a wheeled chassis adjacent either the cab or the body. With an automated vehicle, the container-handling mechanism is typically controllably actuated by pressurized hydraulic fluid selectively directed by controls located at the operator's compartment within the cab. Conventionally, the container-handling mechanism includes opposed gripping members carried at the end of a lifting arm or boom which is extendable and retractable relative to the curb or pick-up side of the vehicle. During travel of the vehicle, the container-handling mechanism resides in an open position with the gripping members extending in opposite directions along the side of the vehicle. After the vehicle is brought to a stop, the boom is extended and the gripping members close to engage the container. The boom is then elevated to position the container adjacent or over a hopper located behind the cab for deposit of the refuse. The boom is successively lowered, the container released and the container-handling mechanism retracted for storage during subsequent movement of the vehicle.

Various problems are encountered when a container-handling mechanism attempts to engage a container. The engagement of gripping members on a container is primarily dependent upon forces of constriction and friction to lift, tilt and maneuver the container. Insufficient force will result in the container slipping from the grasp of the gripping members, especially during dumping, with a resultant fall of the container into the hopper. This problem is accentuated by the natural draft or taper of the containers, so that when tilted, the containers can more easily slip from the grasp of the gripping members. Conversely, a container can be damaged or destroyed by excessive or improperly applied force from the gripping members.

Another problem is that containers of a variety of shapes and sizes are often used in a given geographic area. Conventional prior art gripping members are often limited to engaging and holding specific types and sizes of containers. This requires that a given geographic area must be traversed by more than one collection vehicle or, alternately, by the same vehicle on successive trips following alteration of the gripping apparatus.

While the prior art has proposed some solutions to these problems, these solutions have resulted in complicated gripper assemblies that employ multiple and/or jointed arms, and which require multiple belts, sprockets, and arm actuators powering different arms or arm portions. These designs have resulted in increased manufacturing and maintenance costs.

Therefore, it would be highly desirable to remedy these problems and other deficiencies inherent in the prior art, while providing a simple yet efficient and effective design.

SUMMARY OF THE INVENTION

The present invention preserves the advantages of known collection container engaging mechanisms. In addition, it provides new advantages not found in such currently available devices, and overcomes many of the disadvantages of currently available devices.

The invention is generally directed to a universal engaging mechanism used to handle collection containers of a variety of sizes and shapes. This mechanism self-positions the containers, and can be used in conjunction with a vehicle employing an automated lift arm. The mechanism includes two or more arms or engaging members rotatably mounted to a base. The arms are movable between a closed position in which the container is engaged by the arms and an open position in which the container is released from engagement by the arms. A self-adjusting retainer is located adjacent the base and between the arms. As the arms close about the container, the container is urged in a transverse direction until it abuts the retainer in a fully engaged position. The arms and the retainer cooperate to inhibit longitudinal movement of the container, relative to the arms and the retainer, during handling of the container. ("Transverse" as used here means in a direction normal to the lengthwise axis of the upright container. "Longitudinal" as used here means in a direction along the lengthwise axis of the upright container.)

In an alternative embodiment of the invention, the universal engaging mechanism includes two elongate arms which are semi-arcuate in shape. The arms are preferably channel-shaped or U-shaped in cross-section, and accommodate rubber rollers to facilitate movement of the container in a transverse direction toward the retainer while inhibiting longitudinal movement of the container relative to the arms. In a particularly preferred embodiment, the semi-arcuate arms include four segments: a planar base segment inclined outwardly relative to the centerline of the fully engaged container; an intermediate curved segment; and planar and curved distal segments inclined inwardly relative to the centerline of the fully engaged container (see arm segments "w", "x", "y" and "z" in FIG. 2).

Various types of power actuators can be used to power the arms, including compressed air-actuated cylinders, and hydraulic cylinders. If a hydraulic cylinder is used, it is preferred to use a near-instantaneous adjustment cylinder, to insure a nearly-instantaneous closure of the arms about the container should it slip during handling.

In one preferred embodiment, the retainer of the present invention includes two pivotably mounted rubber pads for frictionally engaging the container and aiding in inhibiting longitudinal movement of the container relative to the pads. In an alternative embodiment, the retainer includes an array of deformable bumpers.

A method for using the universal handling mechanism of the present invention, in cooperation with a lift arm on a vehicle, to engage containers of various sizes and shapes is also disclosed. The method includes the step of first positioning the mechanism in proximity to the collection container. The mechanism includes a self-adjusting retainer located between two arms which are mounted to a base and rotatably movable between open and closed positions. Next, the arms are closed about the container, urging the container in a transverse direction toward the base, until the container is in a fully engaged position abutting the retainer. Now, the collection container can be lifted, tilted and dumped using the lift arm and the engaging mechanism. The arms and the retainer cooperate so that during handling longitudinal movement of the container relative to the arms and the retainer will be inhibited.

According to a preferred method for practicing the present invention, the time taken to engage the container is approximately equal to the time taken to release the container.

BRIEF DESCRIPTION OF THE DRAWINGS

The novel features of the invention are set forth in the appended claims. The invention itself, however, together with further objects and attendant advantages, will be best understood by reference to the following description taken in connection with the accompanying drawings in which:

DESCRIPTION OF THE PREFERRED EMBODIMENTS

Figure 1:
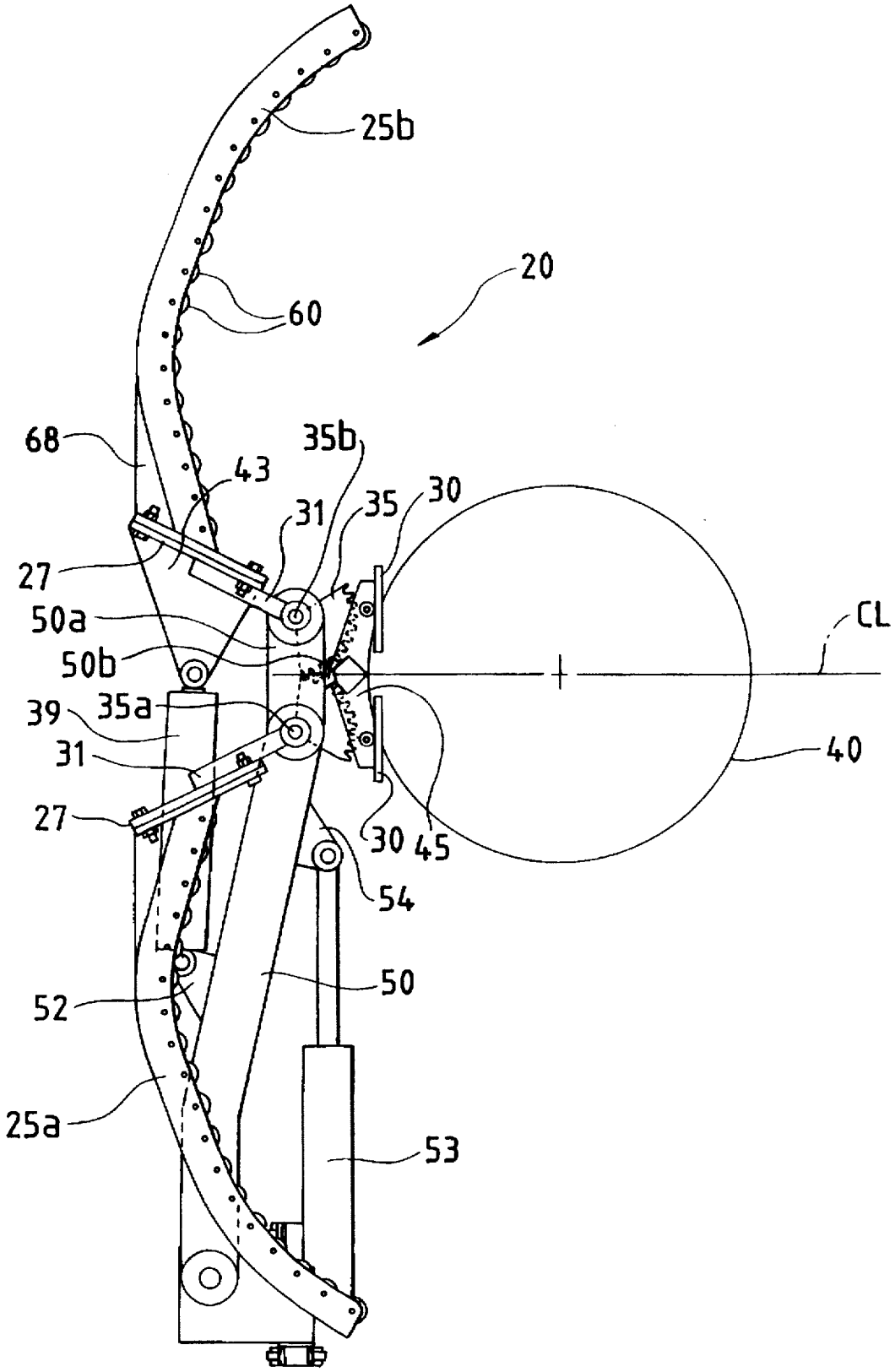
FIG. 1 is a top view of the universal engaging mechanism of the present invention, shown with the arms in an extended position.
Figure 11:
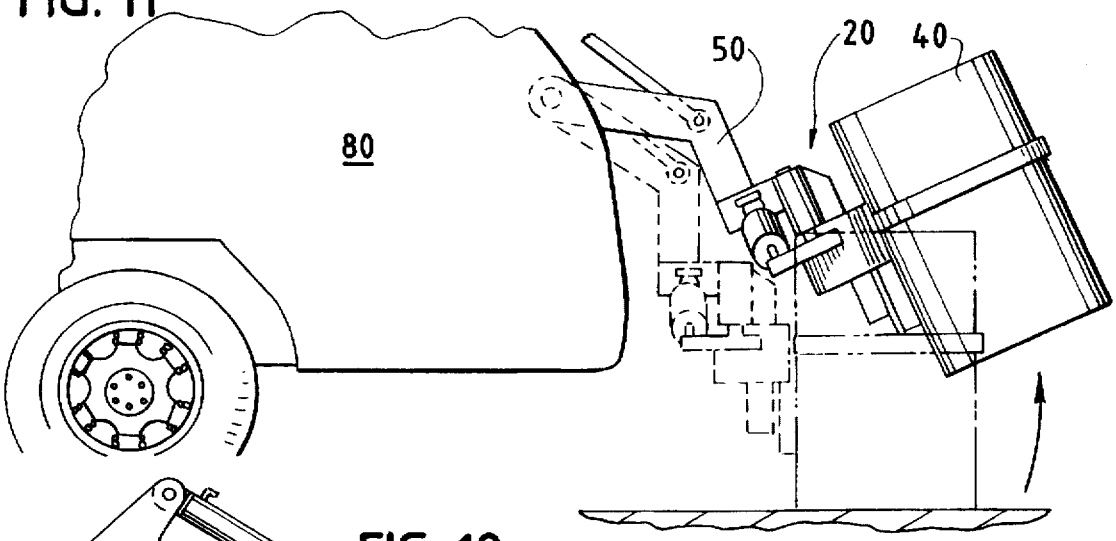
FIGS. 11–13 show a typical lifting, tilting and dumping operation for a collection container engaged by the universal engaging mechanism of the present invention.
Figure 12:
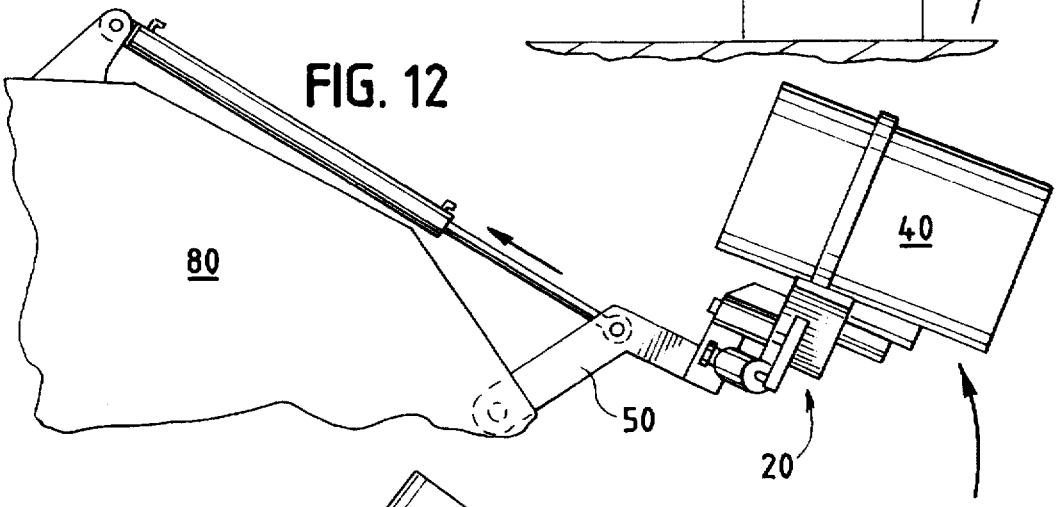
Figure 13:
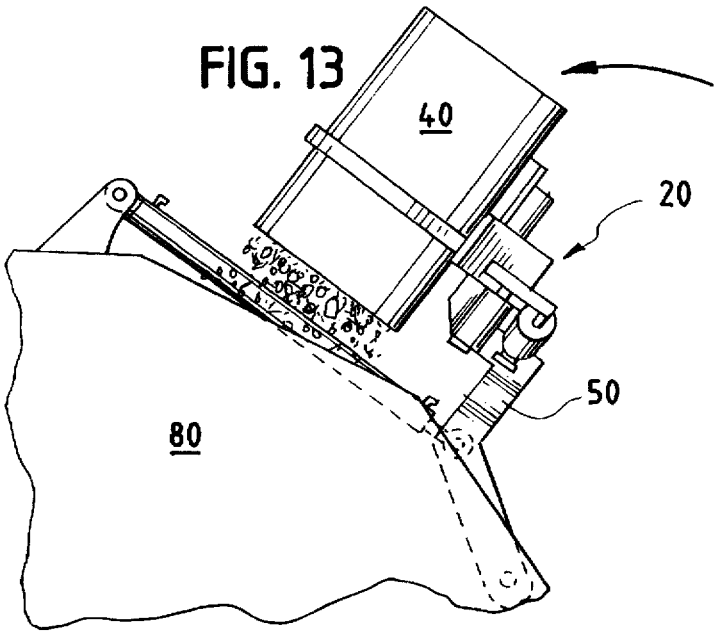
Figure 15:
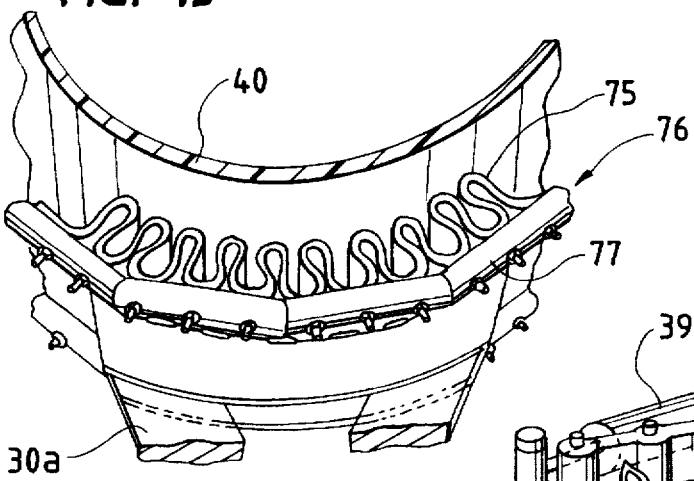
FIGS. 14–17 illustrate a third embodiment of the engaging mechanism of the present invention, utilizing an alternative retainer employing vertically extending loops.
Figure 14:
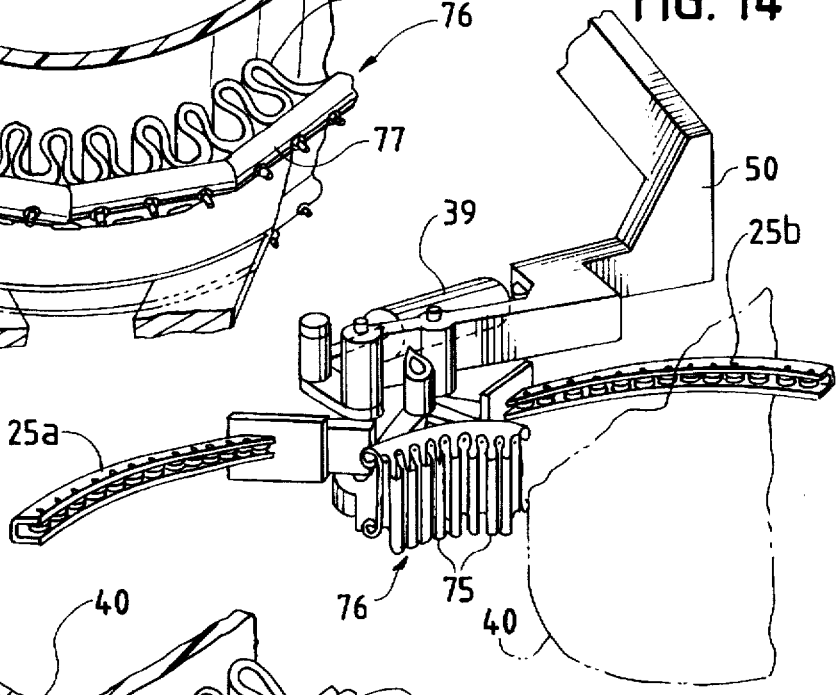
Figure 16:
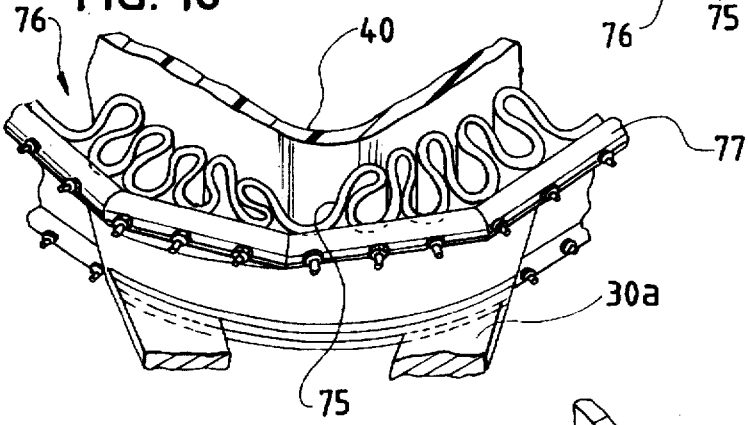
Figure 17:
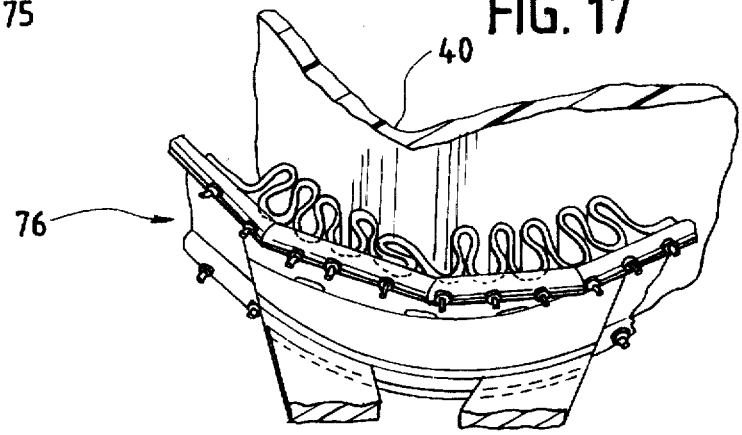

Referring now to FIG. 1, the preferred embodiment of the universal engaging mechanism of the present invention, designated generally as reference numeral 20 in the drawings, is illustrated. The present invention may be mounted on any suitable vehicle. While FIGS. 11–13 show a cab 80 with an automated arm or boom 50 mounted for movement forward of the cab (a "frontloader"), it will be understood that the present invention is readily adaptable for a variety of other uses, including nonvehicular stationary use, use with vehicles that load non-refuse materials, or use with vehicles that load from the side or the rear of the cab.

As shown in the drawings, boom 50 can be directly connected to universal mechanism 20 of the present invention. Alternatively, the boom can be connected to a pick-up arm, as described in U.S. Ser. No. 08/118,546, filed Sep. 9, 1993, now U.S. Pat. No. 5,470,187, as well as its continuation, U.S. Ser. No. 08/482,031, filed Jun. 7, 1995; now U.S. Pat. No. 5,601,392 these disclosures are hereby incorporated by reference in their entirety into this disclosure. Whether or not a pick-up arm is used, the engaging mechanism 20 can thus be used to handle containers 40 of various sizes and shapes, as shown in the drawings, and as explained in more detail below.

Referring back to FIG. 1, engaging mechanism 20 includes at least two engaging members, such as elongate arms 25*a* and 25*b*, which are shown in an extended position. Arms 25*a* and 25*b* are rigidly connected to arm plates 27, with shoulders 68 providing further support for the arms. Plates 27 are connected to arm supports 31, which are in turn rigidly connected to pivot pins 35*a*. Gears 35 are pivotally connected to pivot pins 35*a*.

Figure 2:
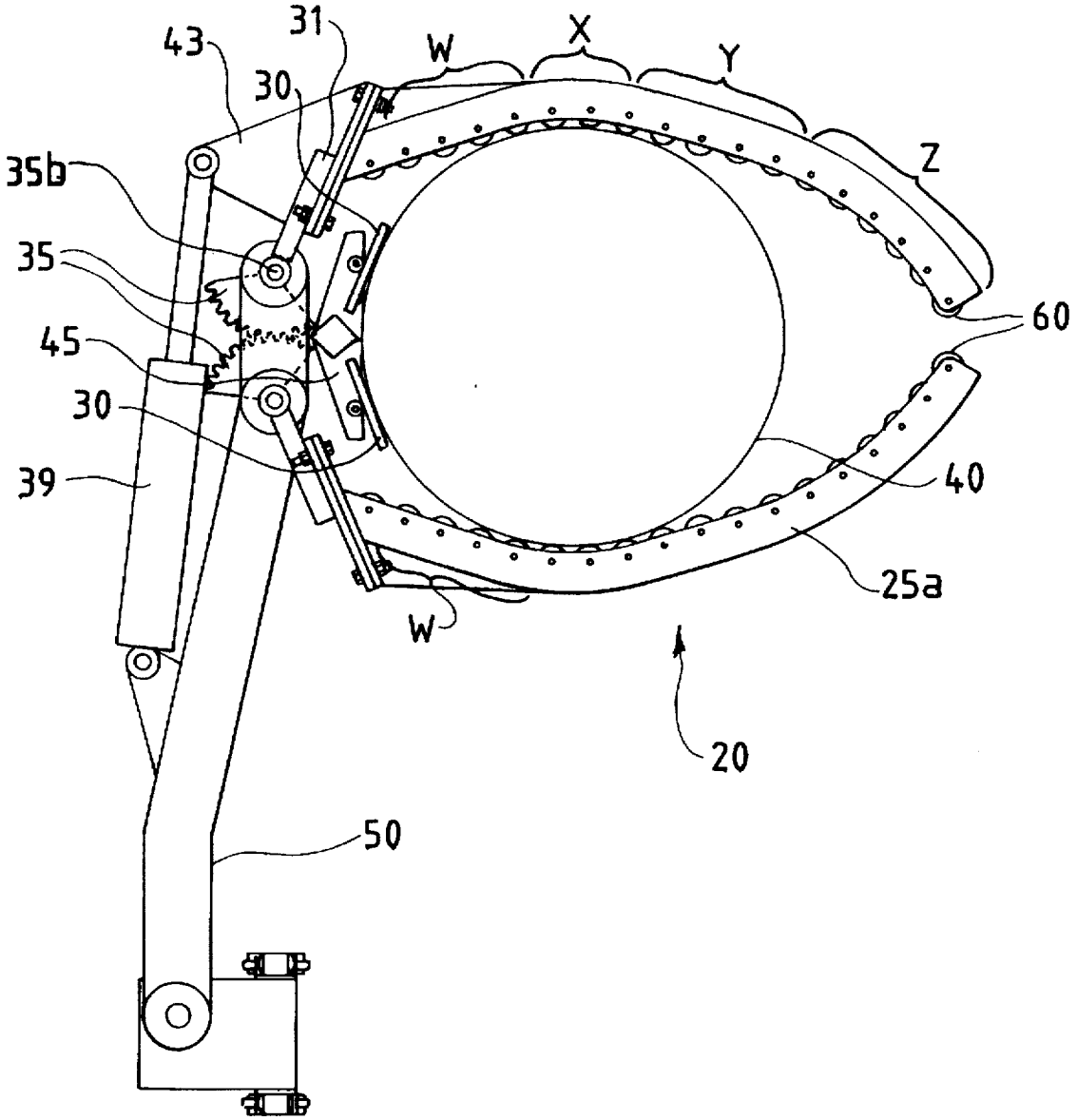
FIG. 2 is a top view of the engaging mechanism of the present invention shown in a retracted position gripping a cylindrical collection container.

Referring to FIGS. 1 and 2, a suitable self-adjusting retainer for frictionally engaging the rear of container 40, such as two pivotally mounted retainer pads 30, is located between arms 25. Retainer pads 30 are preferably made from or coated with an elastomeric material, such as rubber, and are pivotally attached to a base or pad support 45 which, in turn, can be rigidly connected to a distal end portion 50*a* of lift arm 50, such as by weld 50*b* (shown in FIG. 1 only, for simplicity). As shown in FIGS. 2–10*d*, pads 30 can be rotated in a direction toward each other, but the configuration of base 45 will preferably not permit pads 30 to be rotated in a direction away from each other (see, e.g., FIG. 4*a*). Alternatively, stops can be used, for example, to limit this movement of pads 30. The inward pivoting of pads 30, as shown in FIG. 2, facilitates the gripping of circular collection containers 40 by engaging mechanism 20.

However, it has been found that if pads 30 are permitted to rotate in a direction away from each other, this can cause unnecessary deformation or damage to rectangular containers.

The arms can be powered in a variety of different ways. A preferred manner is now described. Referring to FIGS. 1–2, a hydraulic or air cylinder 39 links an intermediate portion of boom or lift arm 50, via ear 52, to triangular support 43; triangular support 43 is rigidly connected to arm **25*b* through plate 27. When the piston within cylinder 39 is extended, arm 25*b* will rotate clockwise about its pivot pin 35*a* (compare FIGS. 1 and 2), causing intermeshed gears 35 to interact, thereby moving arm 25*a* in a counterclockwise direction. Arms 25 can thus be moved between open and closed positions to grip and release a variety of collection containers, designated generally as 40 in the drawings, as demonstrated in FIGS. 1 and 2. Referring to FIG. 1, cylinder 53 (shown in FIG. 1, but not shown for simplicity in FIGS. 2–7), which can be connected at ear 54 to a suitable support structure such as lift arm 50, powers the movement of lift arm 50**.

Of course, a variety of other structures can be used to power arms 25. For example, each arm could have a separate cylinder associated with it, or one arm could pivotally attach to the other using a link, with one of the arms being actuated by a cylinder. As other nonlimiting examples, a chain-and-sprocket assembly could be used to power the arms, or rotary actuators could be employed.

Figure 3:
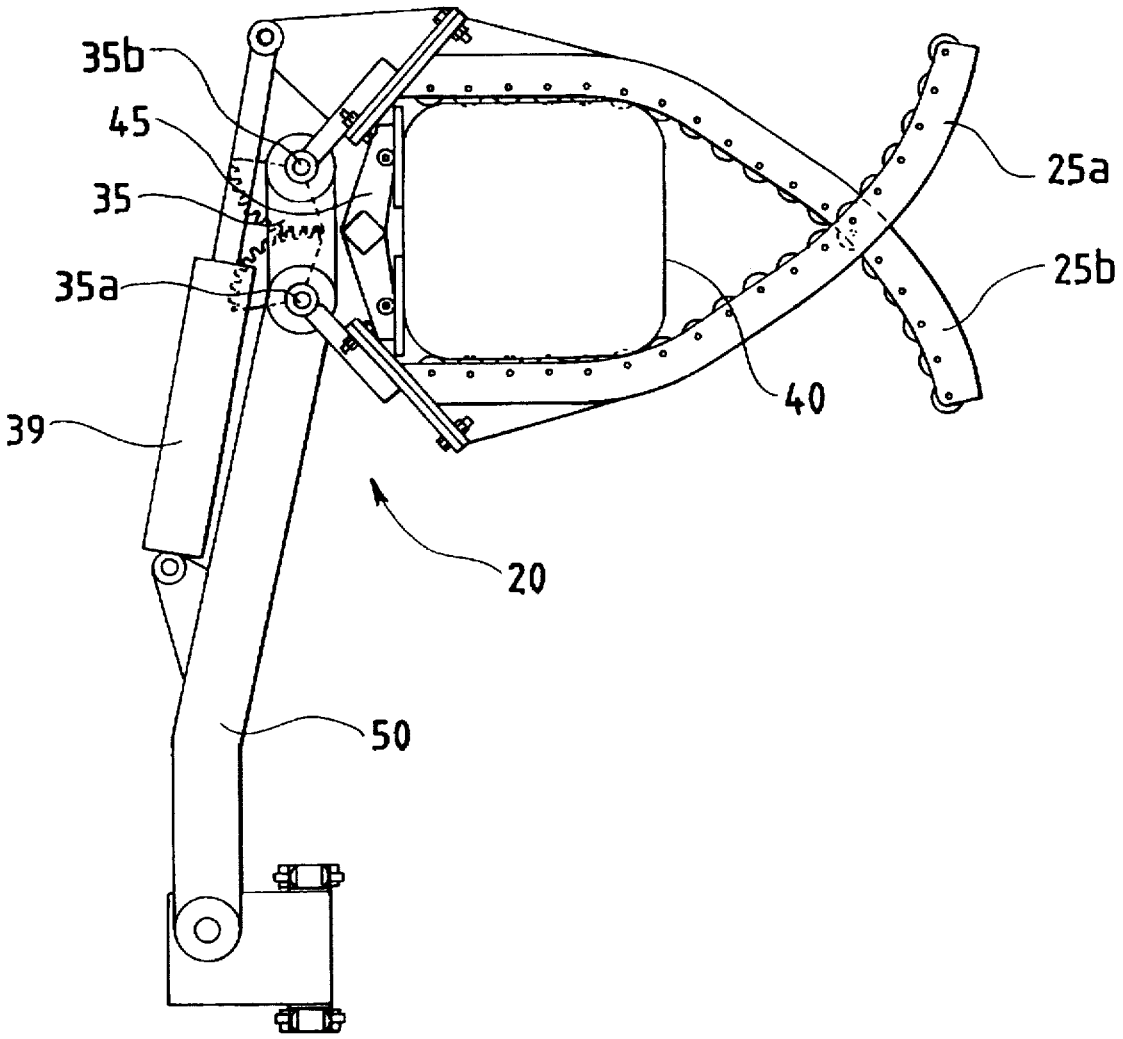
FIG. 3 is a top view similar to FIG. 2 showing the engaging mechanism in a retracted position gripping a square collection container.

Referring now to FIG. 3, arms **25*a* and 25*b* need not be positioned in the same horizontal plane, permitting their overlap. This overlapping feature facilitates the engagement of small collection containers. In this embodiment, because the arms are not in the same horizontal plane the container could be tilted or flipped sideways as the arms close about the container; for this reason, it may be desirable to minimize the vertical displacement between the arms. In another embodiment, the arms can extend at inclined angles relative to the horizontal or ground, so that one arm is canted or tilted upwards while the other arm is canted or tilted downwards. Alternatively, only portions of the arms, such as the distal portions, can be angled up and down, respectively, to achieve this overlapping feature. Of course, if relatively large containers are handled (see, e.g., FIGS. 2, 4 and 7**), this overlapping arm feature is not necessary, and the entire arm portions can be located in the same horizontal plane.

It will be understood that only one of the arms needs to be movable. However, it is preferred that both arms be rotatable since if one arm is fixed, it will project in a direction transverse to the length of the vehicle, extending curbside and posing both a traffic obstruction and a potential safety hazard. In another alternative embodiment, more than two arms could be used to achieve the functional benefits of the present invention, at the cost of simplicity in design.

FIGS. 8–10D illustrate a second, although slightly different, embodiment of the universal engaging mechanism 20 of the present invention than shown in FIGS. 1–7. In this embodiment, piston rod **39*a* of cylinder 39 is connected to pin 49, which is connected to link 48. Link 48 rotates about a first pivot pin 35*a*; pivot pin 35*a* is, in turn, connected to gear wheel 35 (shown in FIG. 10D). Pivot pin 35*b* is also connected to a similar gear wheel 35. Base or pad support 45 is rigidly connected at pin 30*b* to a distal portion 50*a* of lift arm 50. When piston rod 39*a* extends from cylinder 39, link 48 is rotated counterclockwise, causing gears 35 to interact, and closing arms 25 so that they rotate toward each other. Similarly, retraction of piston rod 39*a* within cylinder 39 causes an outward rotational extension of arms 25**.

The preferred construction of arms 25 will now be described in more detail. As shown most clearly in FIGS. **8–10*d*, arms 25 are preferably channel-shaped in cross-section and accommodate elastomeric (e.g., rubber) rollers 60 mounted within the inner portion of the channel. Rollers 60 are oriented so that they are generally parallel to the plane containing elongate arms 25. Arms 25*a* and 25*b*** can be made of extruded aluminum in a single extrusion, and are preferably relatively thin, enabling the arms to easily cross-over or overlap if desired, yet are of a sufficient strength to withstand the loads involved in handling collection containers.

Figure 10A:
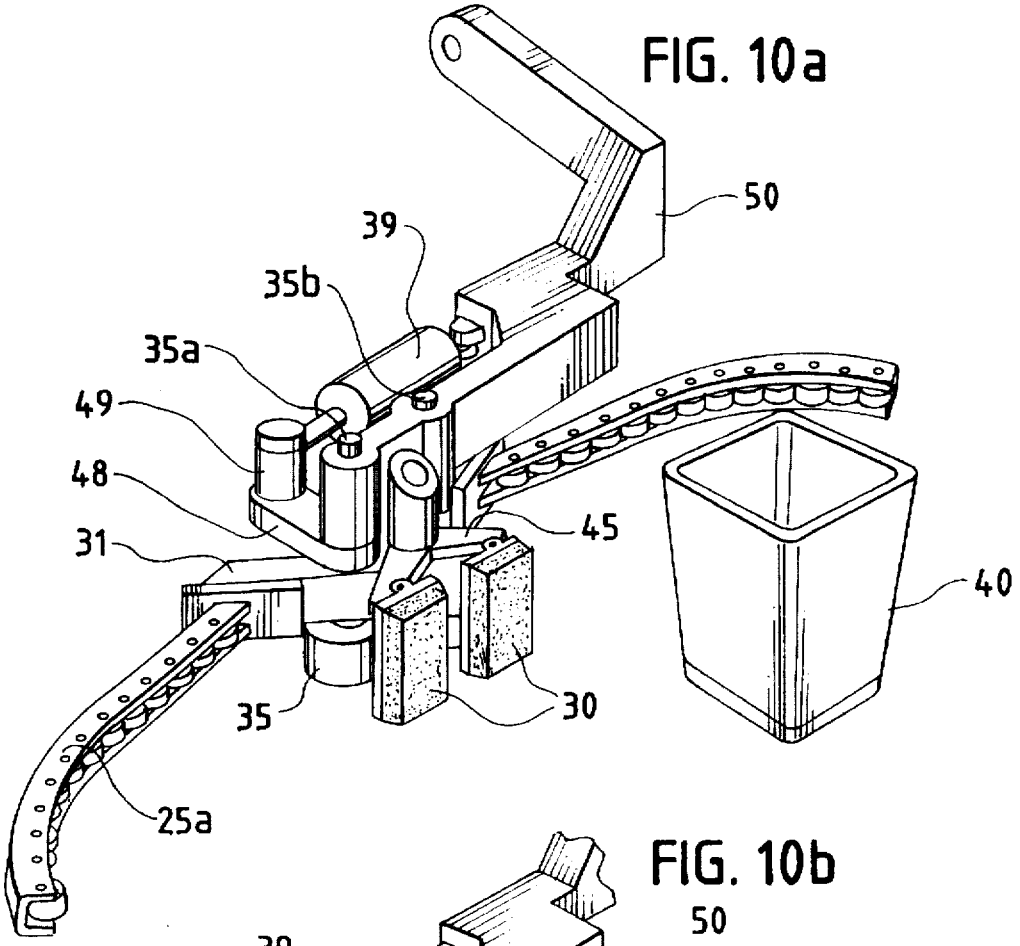
FIGS. 10A–10D illustrate sequential movement of the engaging mechanism shown in FIG. 8 between an extended position, two intermediate positions and, finally, a retracted position.
Figure 10B:
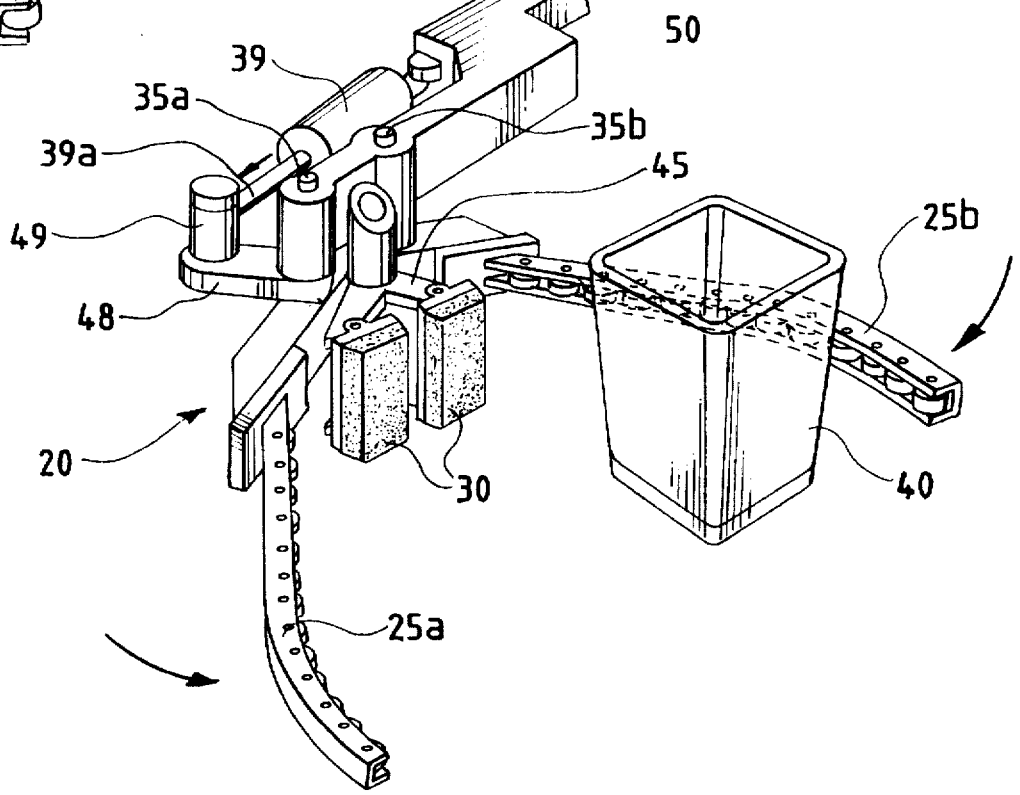
Figure 10C:
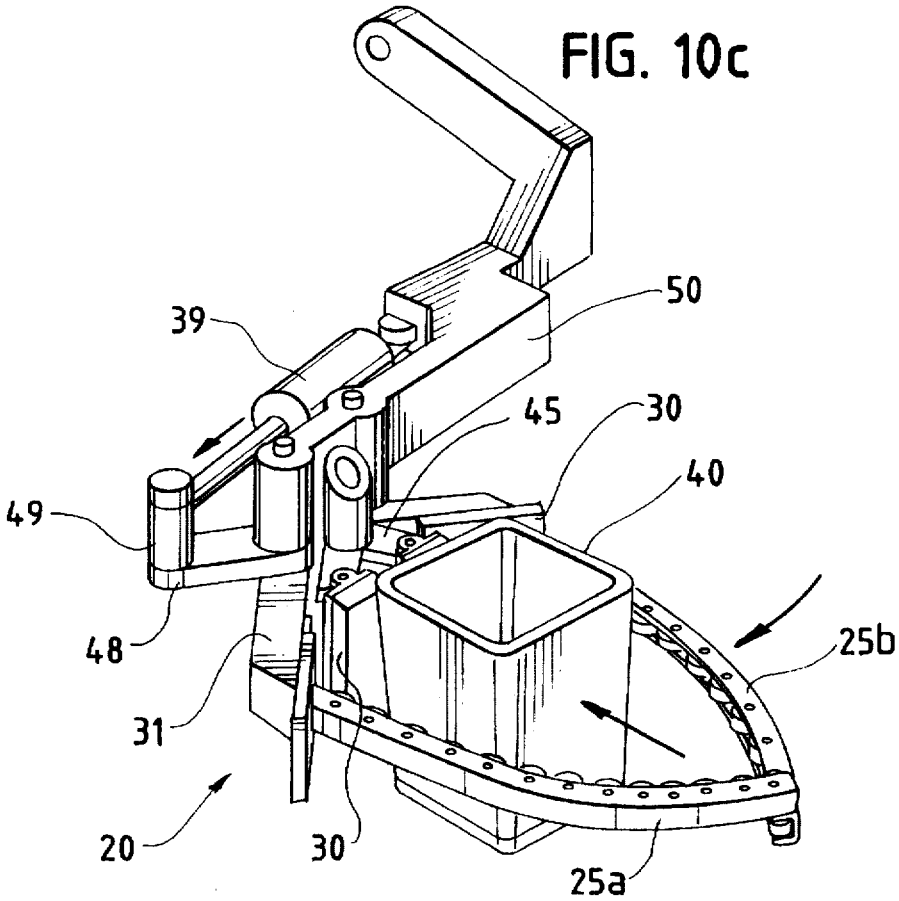
Figure 10D:
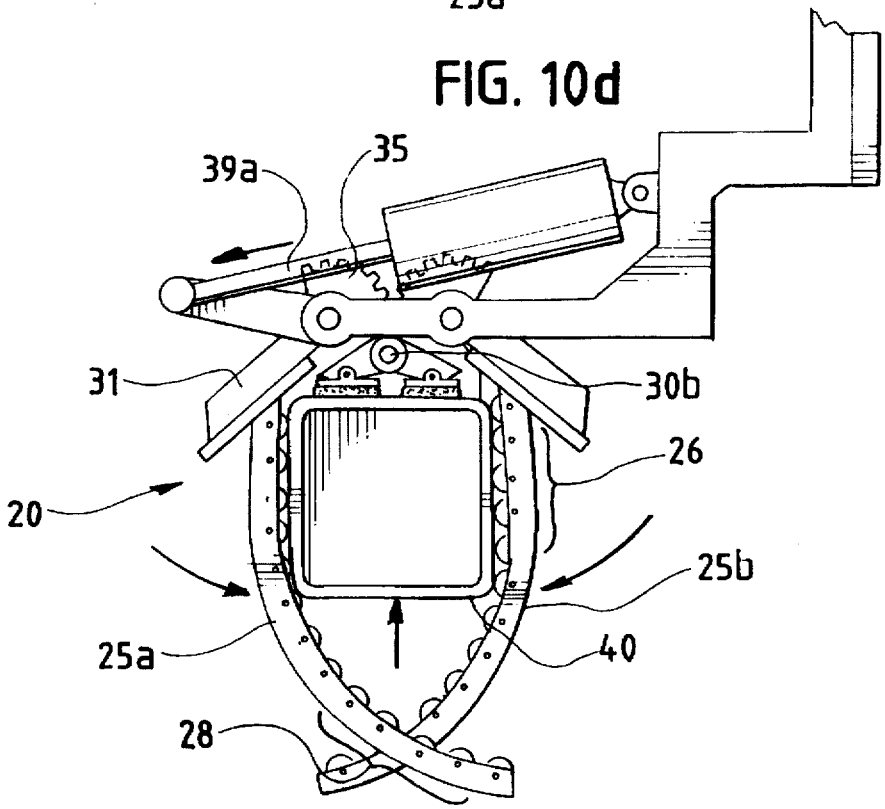

Due to the rotation of rollers 60 and the semi-arcuate shape of arms 25 (discussed below), as shown in FIG. 10D, collection container 40 will be urged toward retainer pads 30 as arms 25 are rotated closed. This movement in the transverse direction will continue until container 40 is in a fully engaged position abutting retainer pads 30. However, even during this transverse movement, rollers 60 will continue to frictionally engage container 40, preventing container 40 from longitudinal movement (i.e., in a vertical direction) relative to arms 25.

Thus, during the lifting operation of boom 50, engaging mechanism 20 will cause collection container 40 to slide in a transverse direction toward pads 30, as shown by the direction of the arrows in FIGS. 10C and 10D. Once the collection container is in frictional contact with the self-adjusting retainer such as pads 30, it has been found that the frictional contact between rollers 60 and retainer pads 30 on the one hand, and the sides of collection container 40 on the other hand, will firmly hold the collection container in place during subsequent lifting, tilting and dumping of the container.

It will be appreciated that the inner, concave portions of arms 25 can be constructed of any other suitable materials and/or structure that will facilitate the transverse sliding movement of the container toward retainer 30, while inhibiting longitudinal slippage of the container relative to arms 25.

The semi-arcuate shape of the arms is also a highly desirable aspect of the present invention. It has been found that a semi-arcuate arm shape facilitates movement of the container toward retainer pads 30 during closing of the arms about the container, while also aiding in the engagement of collection containers of a variety of sizes and shapes without distorting or deforming the container sides. For example, the use of a curved distal segment (see segment "z" in FIG. 2) is desirable to urge the container against retainer pads 30. However, the distance between the arm portions adjacent the base (see segments "w" in FIG. 2) should not be too close; otherwise, these arm portions might push the container away from the retainer pads, which is undesirable.

In one embodiment shown in FIG. 10D, the semi-arcuate shape of the arms might simply include the use of a flat segment 26 and an arcuate distal segment 28. In a particularly preferred embodiment, shown in FIG. 2, arms 25 include four distinct segments: a planar base segment "w"; an intermediate curved segment "x"; a planar distal segment "y"; and a curved distal segment "z". Segments "x" and "z" preferably are inclined outwardly and inwardly, respectively, with respect to the centerline of a fully engaged container. Of course, all of the segments could be curved (see FIG. 9), or each segment could be straight. Preferably, however, as explained above, the arms should retain a generally semi-arcuate shape to ensure that the container can be urged toward the base, and also that it can be sufficiently engaged so that its longitudinal movement is limited.

The shape of the arms shown in the preferred embodiment of FIGS. 1–7 is particularly desirable because it has been found to reliably engage containers of varying sizes. For example, curved distal segment "z" conforms to the large (e.g. 300 gallon) container shown in FIG. 7, while intermediate curved segment "x" conforms to the shape of the smaller (e.g. 90 gallon) container shown in FIG. 2. It has also been found that with square containers this semi-arcuate shape has a tendency to urge the square container toward retainer 30, without deformation of the container sides, because this arm shape tends to grip square containers on their corners (see FIGS. 4B, 5, and 6), where containers are less deformable.

The use of semi-arcuate arms has also been found useful in engaging containers that are adjacent each other, that abut walls, or that are located in corners. Due to the length of arms 25, the present invention will permit the engagement of containers that are up to two feet away from the retainer pads (or longer, if the arm are made longer). Width restrictions may limit the length of arms 25, however.

As shown in each of the embodiments described in FIGS. 1–7, 8–10D, and 14–17, pivot pins 35*a* and 35*b* are preferably spaced to the rear of (i.e., in the transverse direction from) base 45 and retainer pads 30 a certain predetermined distance; pivot pins 35*a* and 35*b* are also preferable spaced from each other a certain predetermined distance. These predetermined distances permit the spacing between arm segments "w" to be sufficient to allow the arms to fully engage square containers (see FIGS. 3–5). If these predetermined distances are too small, this moves the point of container contact with retainer 30 in a (forward) transverse direction away from the retainer pads, which is not preferable. This is also why it is preferred to have base segments "w" of arms 25 incline outwardly relative to the centerline of a fully engaged container, since this will provide segments "w" with an increased distance between them at the point of container contact with retainer 30, ensuring that the arms do not push the container away from the retainer and that large containers will have adequate frictional contact with retainer 30.

Figure 4A:
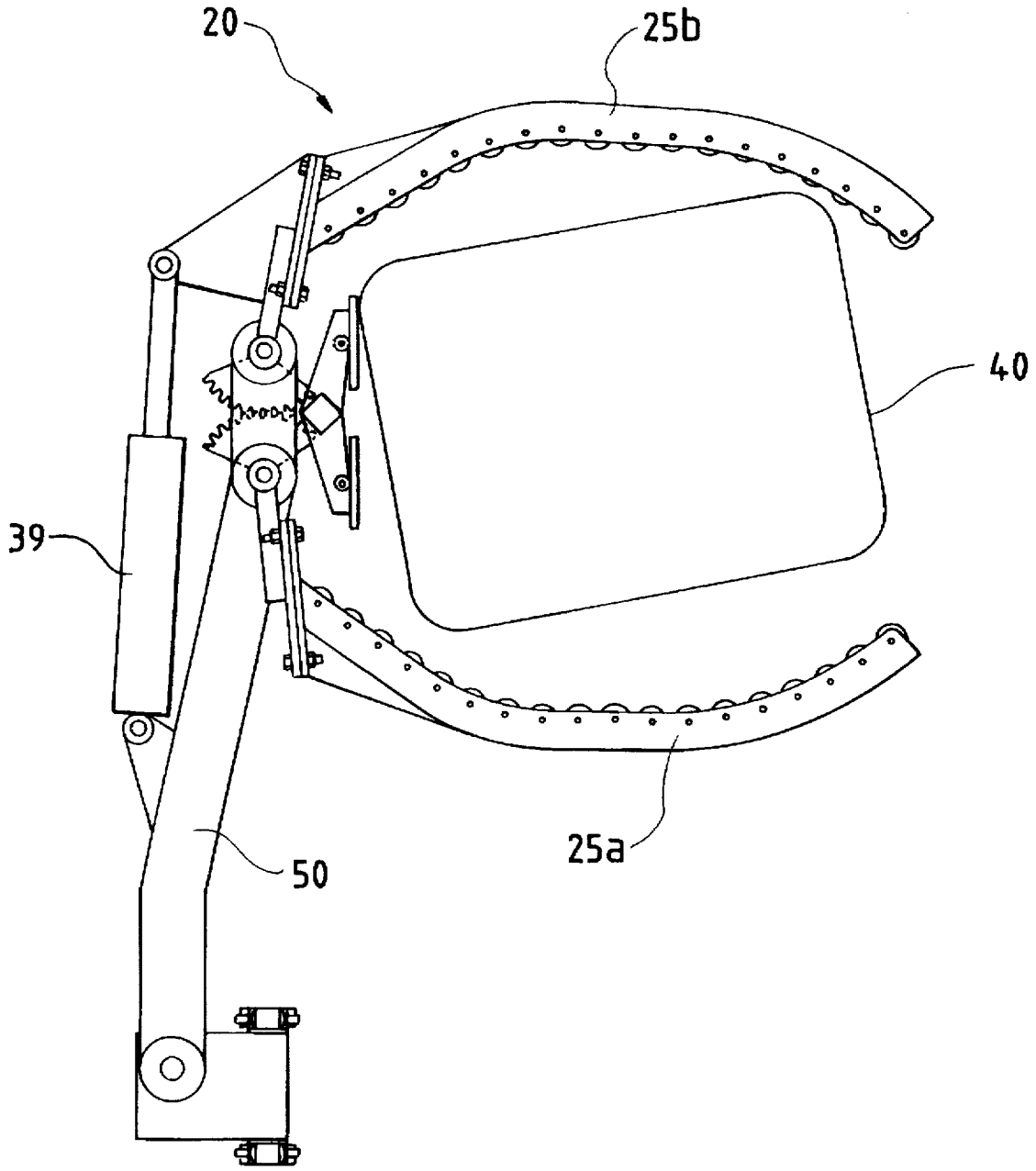
FIG. 4A is a top view showing the engaging mechanism in an intermediate position.
Figure 4B:
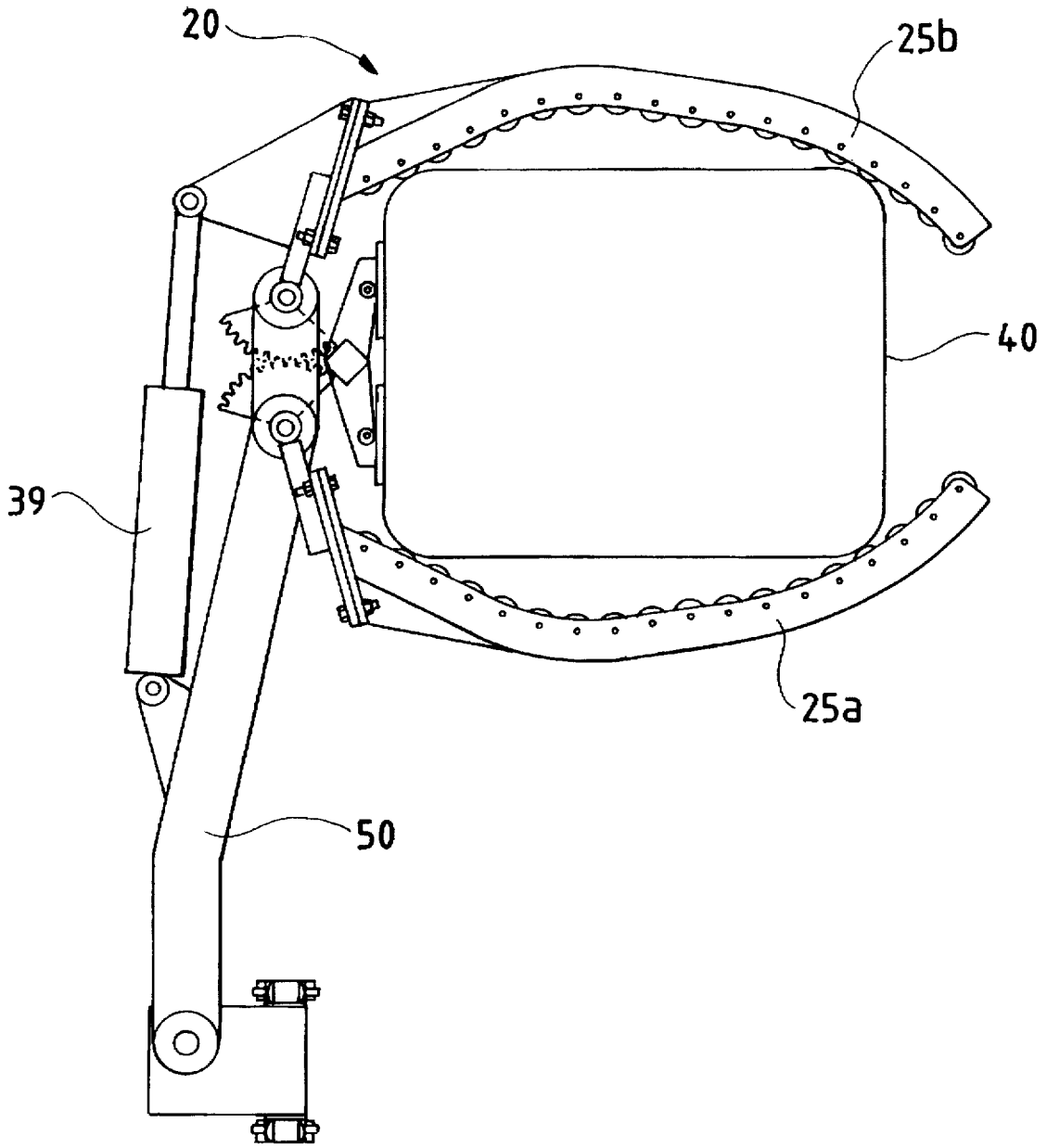
FIG. 4B is a top view showing the engaging mechanism in a retracted position following in sequence from the intermediate position shown at FIG. 4A.
Figure 5:
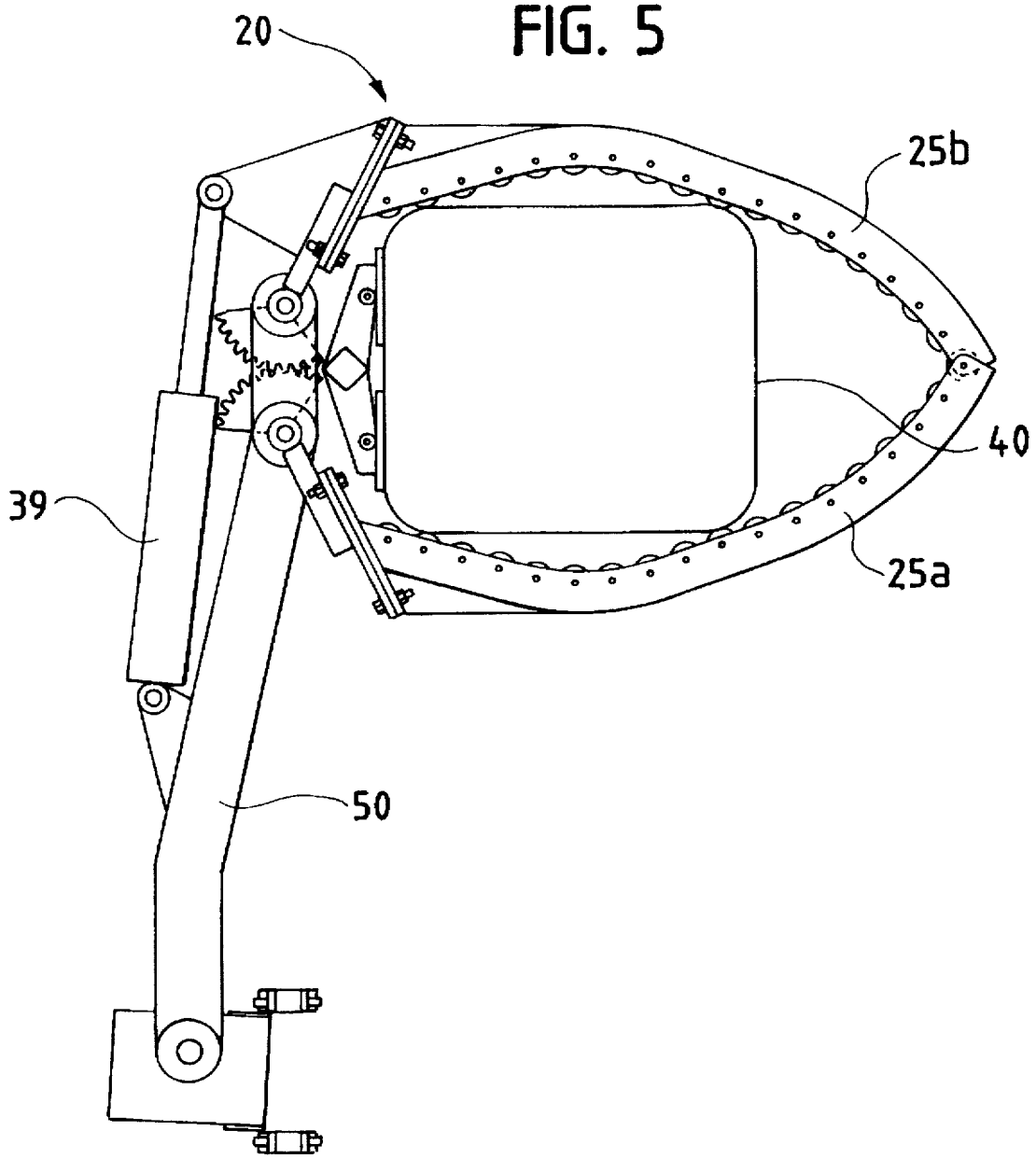
FIGS. 5–7 illustrate the engaging mechanism in a retracted position holding containers of various shapes and sizes.
Figure 6:
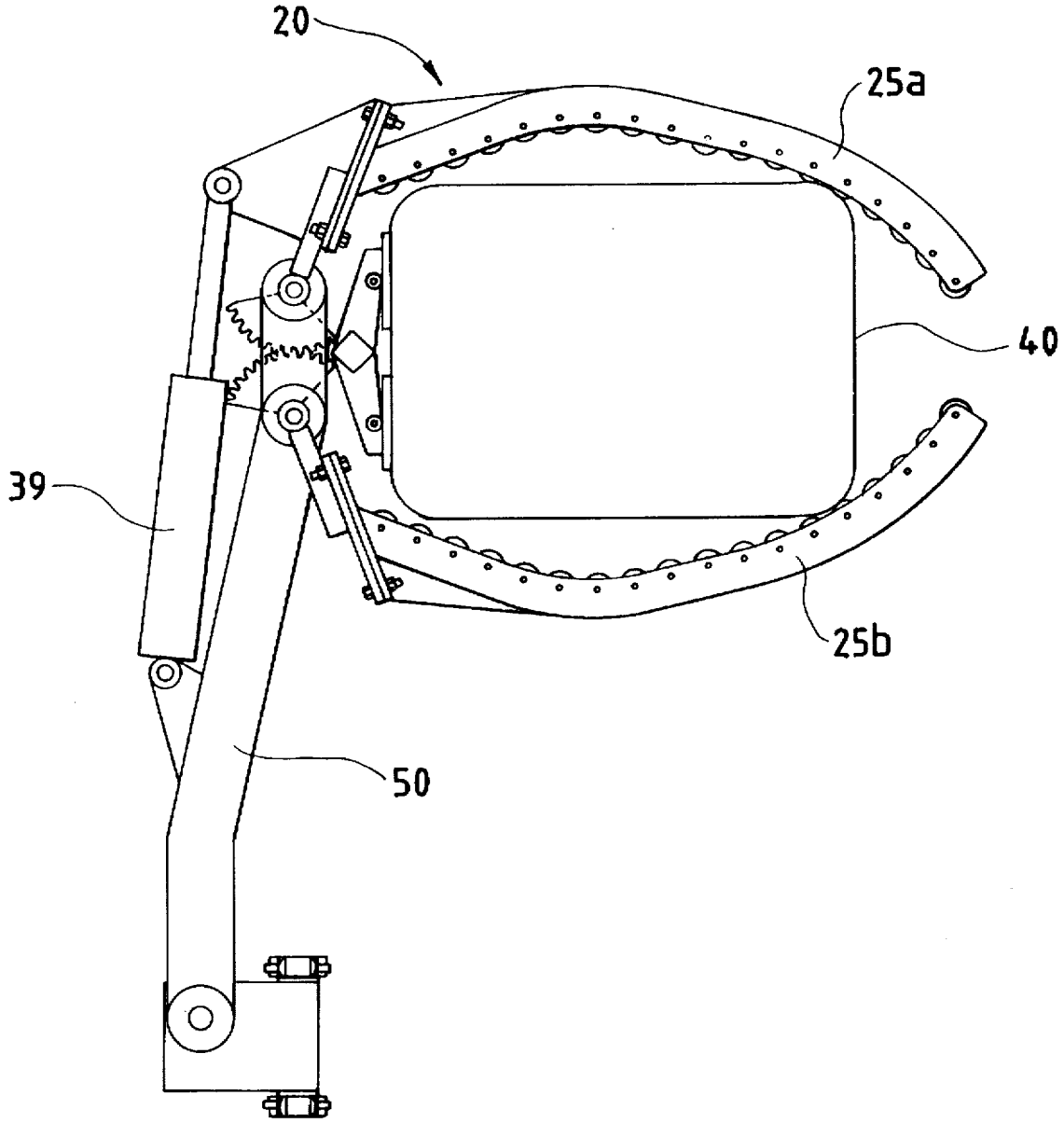
Figure 7:
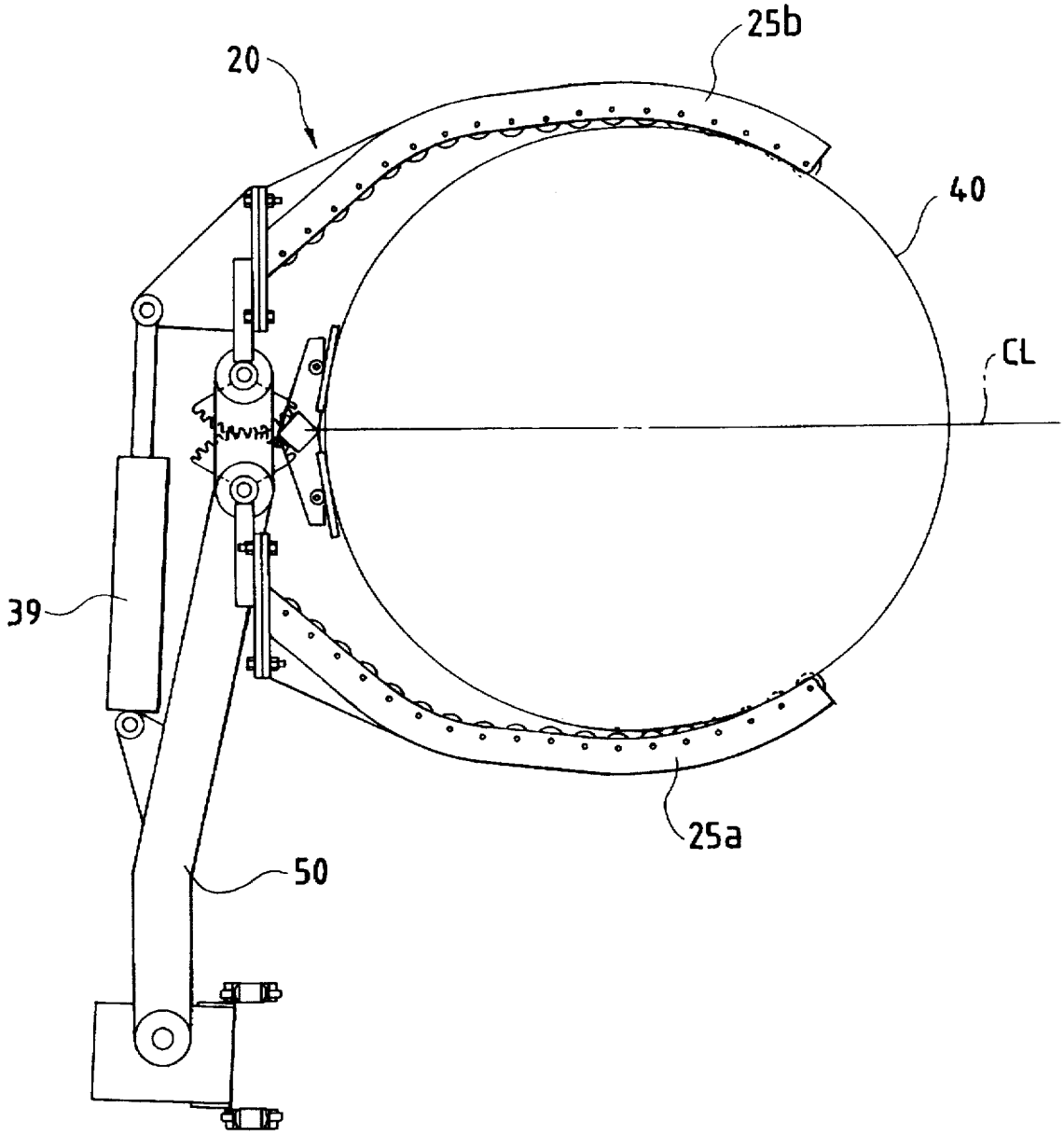
Figure 8:
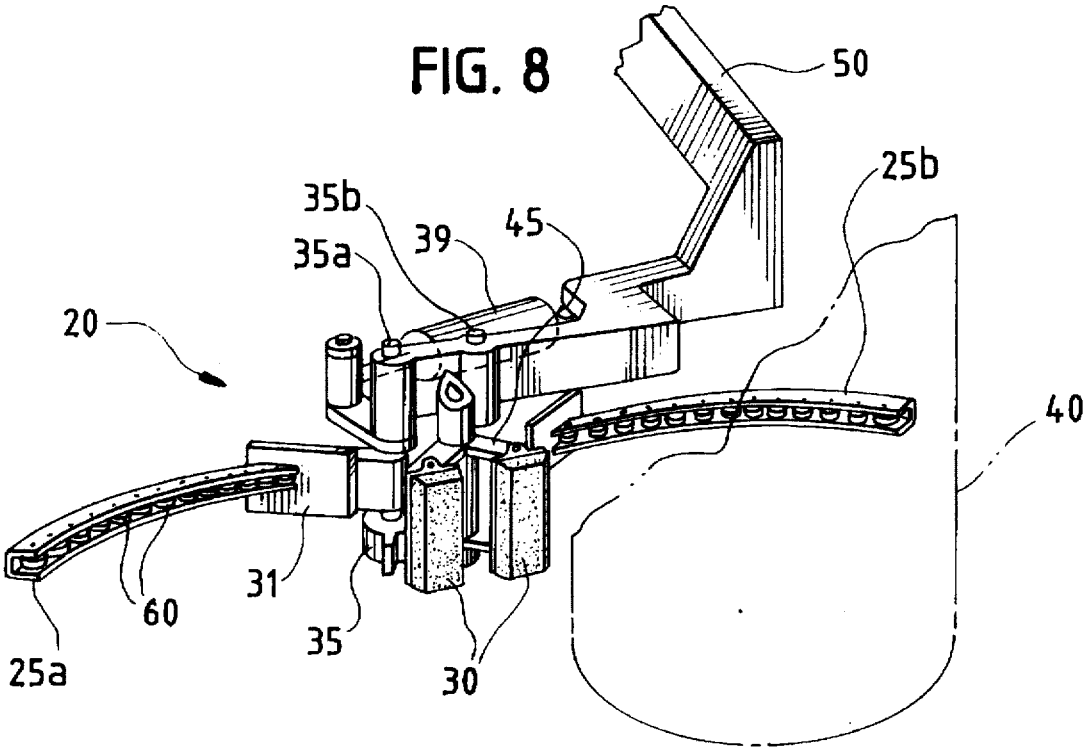
FIG. 8 is a perspective view of a second embodiment of the engaging mechanism of the present invention shown in an extended position.
Figure 9:
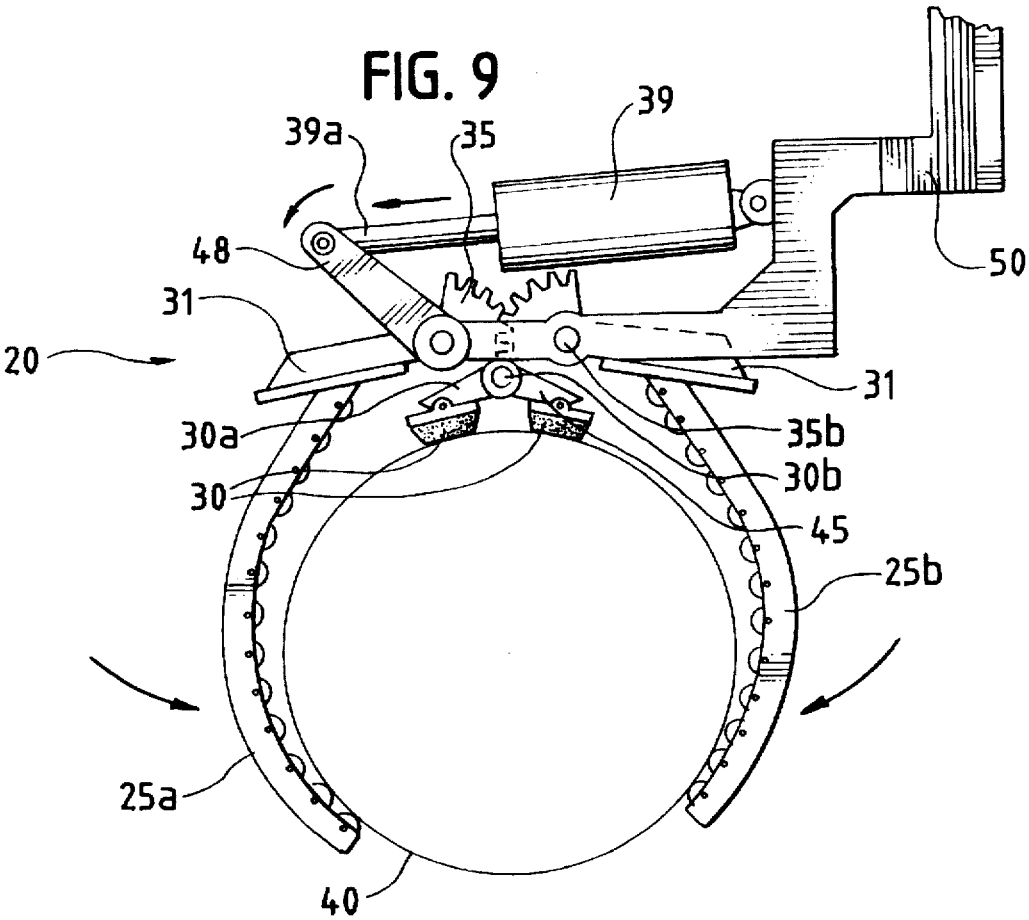
FIG. 9 is a top view of the engaging mechanism shown in FIG. 8.

Referring now to FIGS. 4A and 4B, these drawings illustrate that collection containers that are initially displaced in different off-center orientations can still be engaged by mechanism 20 of the present invention. Due to the shape of arms 25 and the location of retainer 30, as the arms close about the sides of the container, the container will be automatically centered on its centerline ("CL" in the drawings) with respect to retainer 30. This self-centering movement is also facilitated by pivoting rubber retainer pads 30, which facilitate this positioning of the container about its centerline. In this sense, universal engaging mechanism 20 "self-positions" the container prior to lifting and dumping, and retainer 30 is "self-adjusting" to accommodate different size containers.

Figure 19:
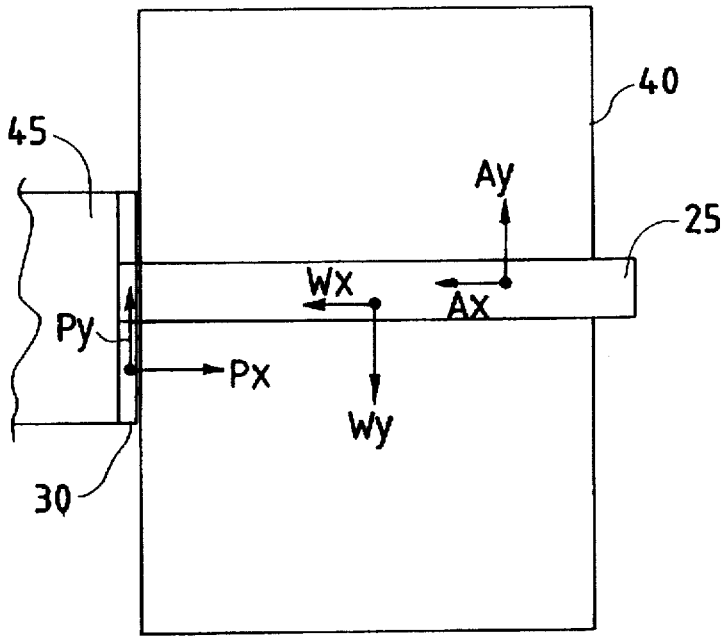
FIG. 19 is an exploded view of a collection container in a fully engaged position, showing the forces and couples acting on the container.

Referring now to FIG. 19, retainer pads 30 are preferably located at a horizontal level below arms 25. When the container is fully engaged (i.e., the container has been urged against retainer pads 30 by arms 25), this positioning engages containers in a particularly effective manner, which will now be described. With the weight W of the container acting downwardly at the container centroid C, it has been found that the retainer pads of the present invention will support a significant amount of the weight W by exerting a force on the container P, having horizontal and vertical components Px and Py, respectively. Similarly, the arms will also support some of this container weight by exerting a force on the container A, having horizontal and vertical components Ax and Ay, respectively. (Ay is neglible until the container is displaced from the horizontal, and will be disregarded in this discussion, as will Wx.) For the container to remain in equilibrium, the vertical and horizontal forces must equal zero, and the sume of the couples created by those forces must equal zero. Therefore, Wy=Py+Ay (or Wy=Py here) and Px=Wx+Ax (or Px=Ax here). Also, Px causes a counter-clockwise moment about centroid C, resulting in the couple d*Px, offsetting the tendency of the container from slipping from the engaging mechanism. Therefore, if the retainer pads do not extend below the horizontal level of the arms (resulting in the couple d*Px), the couple is not available and the arms will carry the entire container weight W. This is not preferred (though it can occur in the unlikely event, for example, that the container is covered in ice), since the arms will not fatigue as quickly if the retainer carries a substantial portion of the container load.

The use of semi-arcuate arms that urge the container toward the retainer pads also results in an engagement of the container that minimizes or eliminates "container sway" that the container might otherwise experience, relative to the arms, as it is handled. "Container sway" as used here means container movement to inclined positions relative to the longitudinal axis of the container, and generally parallel to the direction of container movement. It is important to control container sway, since this container movement can increase the tendency of the container to slip from engagement by the handling mechanism. Also, it has been found that once a container begins to move or slip relative to the arms, it has a tendency to continue to do so, which can result in the container slipping from the arms and falling into the storage bin.

Referring now to FIGS. 14–17, an alternative embodiment for retainer 30 is shown. In this embodiment, pads 30 are replaced with an array or belt, designated generally as 76, of deformable rubber bumpers or protuberances 75. Bumpers 75 can be rigidly supported by a metal support or backing plate 77. FIGS. 14–17 illustrate that resilient bumpers 75 will deform to conform to the shape of the container. It has been found that bumpers 75 have a tendency to deform at the container corners, firmly holding the container in place. As shown, the bumpers 75 adjacent the container corners deform about the longitudinal axis of each bumper, permitting increased surface contact with the container corners; however, bumpers 75 do not appreciably deform about their transverse axis, permitting the bumpers to maintain individual surface contact with the container along the longitudinal depth of the bumpers. Bumpers 75 each have a substantial longitudinal depth that is, preferably, several times the thickness of each "loop" or bumper 75, permitting the bumpers to frictionally contact a relatively large surface area of the container periphery without deforming the container, for enhanced frictional engagement of the container.

Alternatively, an array of bumpers 75 could be provided on the inside (concave) side of the arms, to replace the elastomeric rollers. This will provide arms that are pliable and deformable in the horizontal plane, yet relatively rigid in the vertical plane. Such bumpers used with the arms will effectively engage square containers, but will not permit container movement toward the retainer, or the self-centering container movement resulting from use of the arm rollers with the retainer. Also, a great deal of material such as rubber is used with these bumpers.

While the retainers 30 described here are relatively resilient, and this is preferred to permit the pads or the bumpers to deform to the shape of the container, resiliency is not absolutely necessary. Even the use of a non-resilient material with a relatively high coefficient of friction, such as sandpaper, for example, is contemplated by the present invention. Thus, it will be appreciated that other retainers, or inner arm surfaces, utilizing different materials and having a different structure, can also be used to advantage, provided that such retainers serve to frictionally engage container 40 and prevent its slippage during handling.

Either hydraulic or air cylinders can be used to power the arms. The advantage of air-actuated cylinders is that if the container should slip during handling, thus momentarily creating a gap between a portion of the arms 25 and the container sides, the continuous air pressure within the cylinder will cause the arms to automatically and nearly instantaneously close about and grip the container.

However, this nearly instantaneous closure will not occur with conventional hydraulic-actuated cylinders, and the container can slip from arms powered in this manner. Since hydraulic-actuated cylinders do present advantages over air-actuated cylinders, including enhanced control and the potential need for additional air compressors if air-actuated cylinders are used, it would be advantageous to design a hydraulic cylinder which would provide the nearly instantaneous closure which is required should slippage of the container occur during handling. The present invention also solves this problem, as will now be described.

Figure 18:
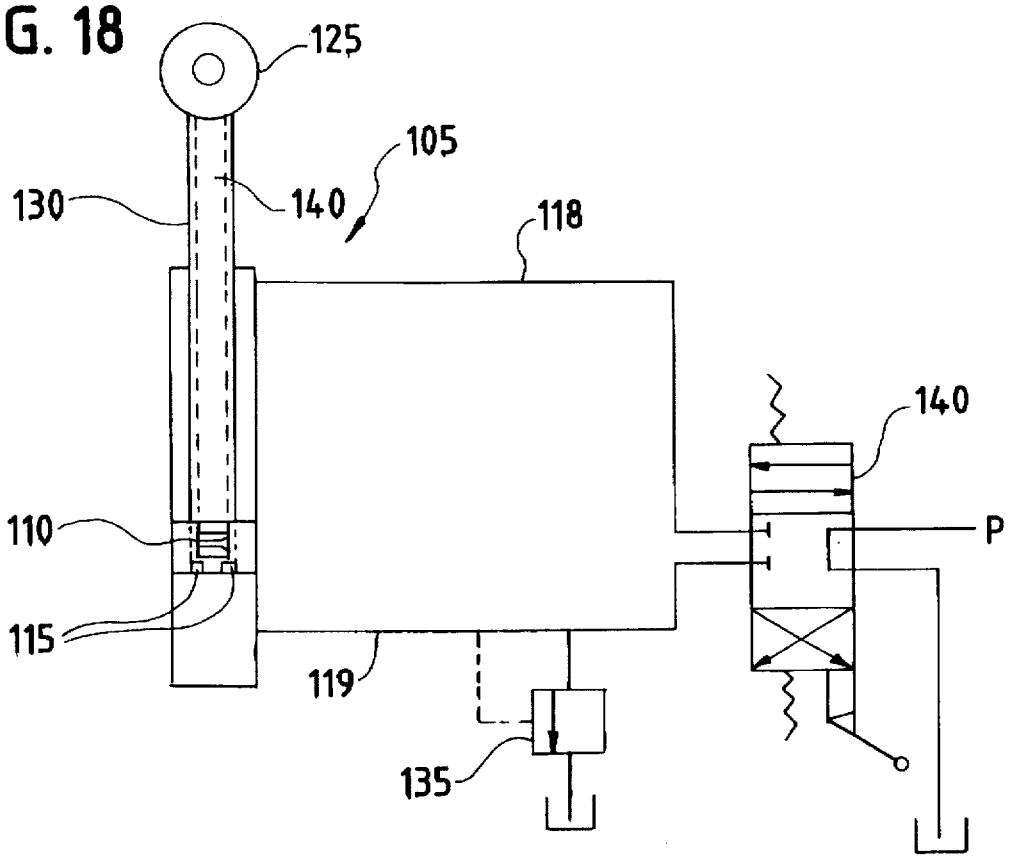
FIG. 18 is a schematic view of a hydraulic diagram for the near-instantaneous adjustment cylinder of the present invention.

With hydraulic cylinders, the problem is to move oil into the cylinder quickly enough to provide the nearly instantaneous closure that is required. A solution to this problem is shown schematically in the hydraulic diagram shown in FIG. 18, which illustrates a near-instantaneous cylinder adjustment device, designated generally as 105. Piston 110 slides vertically within hydraulic cylinder 130; its vertically downward movement is limited by seat 115. One side of cylinder 130 is charged with a gas 140 at a pressure that balances the oil pressure within cylinder 130. Hydraulic lines 118 and 119 connect to opposing sides of hydraulic cylinder 130 (i.e., the side charged with gas 140 and the side with oil). Port relief 135 insures that the pressure within cylinder 130 cannot exceed a certain predetermined maximum level. When arms 25 are free to move, gas 140 expands within cylinder 130, taking piston rod 110 out of its balanced position and allowing oil to work on the piston rod. Thus, if container 40 slips from arms 25, for an instant there will be little or no pressure exerted on the arms by the container. This will cause gas 140 to expand within cylinder 130, pushing oil into the base of hollow cylinder 130, causing rod 110 to extend from cylinder 130, and nearly instantaneously closing arms 25 (not shown in FIG. 18, but connected to attachment 125) about the container.

A conventional hydraulic accumulator can also be used to provide hydraulic cylinders that can nearly instantaneously close should the container begin to slip while engaged by arms 25. However, the use of an accumulator is not preferred, since restriction in the hydraulic lines (due to pressure drops that will occur through the lines) will still tend to slow the ability of the cylinder to actuate the arms in a sufficiently timely manner.

It is also preferred that the "grip" and "release" times (i.e., the time taken for the arms to grip or release the container) are equal. It is particularly desirable that the "grip" and "release" times not be too short (to avoid deforming or punching holes in the container, and to avoid releasing the container while the arm is moving, respectively). While there are many ways of providing arms having equal grip and release times, one preferred way is to provide the arm cylinder/s with full-time regeneration on the extension stroke. Thus, if a 2:1 bore to rod diameter ratio is used, then the extension and retraction speeds will be the same.

A method for using universal engaging mechanism 20 of the present invention is also disclosed. Referring first to FIGS. 10A–10D, the sequence of operations resulting in the engagement of a small square container using the present invention is shown. It can be seen in this sequence of movements that as the arms move to their closed position, square container 40 is urged by the arm movement (as facilitated by rollers 60) toward pads 30. Referring now to FIGS. 11–13, it can be seen that lift arm 50 can be used to move engaging mechanism 20 into lift (FIG. 11), tilt (FIG. 12) and dump (FIG. 13) positions. Thus, to summarize, the method of the present invention involves first positioning mechanism 20 in proximity to collection container 40. Next, arms *25a*, *25b* are closed about the container, causing the container to move in a transverse direction toward base 45 and into abutting frictional engagement with retainer 30. Now, container can be handled using lift arm 50 and engaging mechanism 20, and the retainer and the arms will cooperate during container handling to inhibit longitudinal movement of the container relative to the retainer and the arms.

The method of using the universal engaging mechanism of the present invention also includes the step of releasing. According to the method of the present invention, the time taken to engage the container is approximately equal to the time taken to release the container.

It will be appreciated that the novel construction of arms 25 and their unique function and operation in conjunction with retainer 30 permits engaging mechanism 20 to reliably handle containers of a variety of sizes and shapes, that are displaced in various orientations or locations. The simplicity of the invention, and its use of relatively few moving parts, is thought to be a significant advance both because of its enhanced function (i.e., securely gripping containers of various sizes and configurations), and because of its simple structure, which is economically manufactured, less easily prone to breakage, and more easily field-repairable. As an example of the simplicity of the invention, unlike some prior art container grippers, jointed arms are not used. Instead, non-jointed (defined here as "unitary") arms are used.

It will be understood that the invention may be embodied in other specific forms without departing from the spirit or the central characteristics described here. The present examples of embodiments, therefore, are to be considered in all respects as illustrative and are not restrictive, and the invention is not to be limited to the details given here.

We claim:

1. A universal handling mechanism for engaging containers of different sizes and shapes, the mechanism being movable to facilitate the handling of the containers, comprising:

at least first and second elongate, opposing arms rotatably mounted to a base for movement between a closed position in which the container is engaged by the arms and an open position in which the container is released from engagement by the arms, wherein a distal portion of the first arm is inclined upwardly and a distal portion of the second arm is inclined downwardly;

a retainer located adjacent the base, and between the base and the container;

the arms being adapted when moving toward the closed position to urge the container in a transverse direction toward the base until the container is in a fully engaged position in which it abuts the retainer; and the retainer and the arms being configured to inhibit longitudinal movement of the container relative to the retainer and the arms, and to also inhibit container sway, during movement of the mechanism and handling of the container.

2. A universal handling mechanism for engaging containers of different sizes and shapes, the mechanism being movable to facilitate the handling of the containers, comprising:

at least two elongate engaging members rotatably mounted to a base for movement between a closed position in which the container is engaged by the engaging members and an open position in which the container is released from engagement by the engaging members;

a power actuator for rotating the engaging members, the power actuator ensuring that the time taken to rotate the engaging members to the closed position is approximately equal to the time taken to rotate the engaging members to the open position;

a retainer located adjacent the base, and between the base and the container;

the engaging members being adapted when moving toward the closed position to urge the container in a transverse direction toward the base until the container is in a fully engaged position in which it abuts the retainer; and the retainer and the engaging members being configured to inhibit longitudinal movement of the container relative to the retainer and the engaging members, and to also inhibit container sway, during movement of the mechanism and handling of the container.

3. The handling mechanism of claim 2, wherein the power actuator includes a compressed air-actuated cylinder.

4. The handling mechanism of claim 2, wherein the power actuator includes a hydraulic cylinder with a near-instantaneous adjustment cylinder.

5. A universal handling mechanism for engaging containers of different sizes and shapes, the mechanism being movable to facilitate the handling of the containers, comprising:

at least two elongate arms rotatably mounted to a base or movement between a closed position in which the container is engaged by the arms and an open position in which the container is released from engagement by the arms;

means for ensuring that the time taken to rotate the arms to the closed position is approximately equal to the time taken to rotate the arms to the open position;

a retainer located adjacent the base, and between the base and the container;

the arms being adapted when moving toward the closed position to urge the container in a transverse direction toward the base until the container is in a fully engaged position in which it abuts the retainer; and the retainer and the arms being configured to inhibit longitudinal movement of the container relative to the retainer and the arms, and to also inhibit container sway, during movement of the mechanism and handling of the container.

6. The handling mechanism of claim 5, wherein the arms are unitary, and the arms include rubber rollers to facilitate transverse movement of the container toward the retainer while substantially limiting longitudinal movement of the container relative to the arms.

7. The handling mechanism of claim 5, wherein the retainer includes two or more pivotably mounted rubber pads for frictionally engaging the container and for inhibiting longitudinal movement of the container relative to the pads.

8. The handling mechanism of claim 5, wherein the retainer includes an array of deformable bumpers.

9. The handling mechanism of claim 5, wherein each of the arms is constructed in a generally semi-arcuate shape.

10. The handling mechanism of claim 5, wherein the arms include a planar base segment inclined outwardly relative to the centerline of the fully engaged container, segments inclined inwardly relative to the centerline of the fully engaged container.

11. The handling mechanism of claim 5, wherein the arms pivot about axes which are displaced in the transverse direction from the base.

12. The handling mechanism of claim 5, wherein the arms rotate within different generally horizontal planes.

13. The handling mechanism of claim 5, wherein at least a portion of the retainer is located below a horizontal plane containing the arms.

14. The handling mechanism of claim 5 including two opposing arms that pivot about a pair of arm pivots, wherein the arm pivots are located a first predetermined distance from each other, and the arm pivots are also each located an equal, second predetermined distance from the retainer, the first and second predetermined distances being sufficiently large to permit the handling mechanism to engage containers having rectangular cross-sections.

15. A method for handling collection containers of various sizes and shapes using a vehicle employing a lift arm connected to an engaging mechanism, comprising the steps of:

positioning the mechanism in proximity to a collection container, the mechanism including a self-adjusting retainer located between two arms, the arms being mounted to a base and rotatable between open and closed positions;

closing the arms about the container, causing the container to be centered relative to the retainer and urging the container toward the base until the container is in a fully engaged position abutting the retainer;

handling the collection container using the lift arm and the engaging mechanism, the retainer and the arms cooperating to inhibit longitudinal movement of the container relative to the retainer and the arms, and to also inhibit container sway, during container handling; and opening the arms to disengage the container following container handling, wherein the time taken to close the arms about the container is approximately equal to the time taken to open the arms and release the container.

* * * * *